US005778702A

United States Patent [19]

Wrightenberry

[11] Patent Number: 5,778,702

[45] Date of Patent: Jul. 14, 1998

[54] DOUBLE PLY SOCK AND METHOD OF MAKING SAME

[76] Inventor: Jerry O. Wrightenberry, 3110 Forestdale Dr., Burlington, N.C. 27215

[21] Appl. No.: 708,252

[22] Filed: Sep. 6, 1996

[51] Int. Cl.[6] ..... D04B 1/26; A41B 11/00

[52] U.S. Cl. ..... 66/178 R; 66/171; 66/185; 2/239

[58] Field of Search ..... 66/196, 171, 178 R, 66/185; 2/239

[56] References Cited

U.S. PATENT DOCUMENTS

| | | | |
|---|---|---|---|
| 379,831 | 3/1888 | Sutro . | |
| 2,633,446 | 3/1953 | King | 167/84 |
| 3,259,915 | 7/1966 | Dison | 2/239 |
| 3,307,379 | 3/1967 | Woolley et al. | 66/178 |
| 4,341,096 | 7/1982 | Safrit et al. | 66/185 |
| 4,373,215 | 2/1983 | Guigley | 2/239 |
| 4,467,626 | 8/1984 | Coble et al. | 66/196 |
| 4,571,960 | 2/1986 | Hursh et al. | 66/196 |
| 4,615,188 | 10/1986 | Hursh et al. | 66/196 |
| 4,843,844 | 7/1989 | Hursh et al. | 66/196 |
| 5,095,548 | 3/1992 | Chesebro | 2/239 |
| 5,226,194 | 7/1993 | Staley | 2/239 |
| 5,319,807 | 6/1994 | Brier | 2/239 |
| 5,353,524 | 10/1994 | Brier | 2/239 X |
| 5,402,540 | 4/1995 | Williams | 2/239 |
| 5,416,929 | 5/1995 | Braunstein | 2/406 |
| 5,453,268 | 9/1995 | Ueno et al. | 424/76.8 |
| 5,590,420 | 1/1997 | Gunn | 2/239 X |
| 5,615,418 | 4/1997 | Pruit | 2/239 |

FOREIGN PATENT DOCUMENTS

| | | | |
|---|---|---|---|
| 96353 | 4/1897 | Germany | 66/178 |

*Primary Examiner*—John J. Calvert
*Attorney, Agent, or Firm*—Rhodes, Coats & Bennett, L.L.P.

[57] ABSTRACT

A double layer sock has an inner ply having a foot portion that is undyed and a dyed outer ply covering the inner ply and joined to the inner ply at an upper end of the inner and outer plies. The inner ply is formed of antimicrobial and/or hydrophobic yarns.

A method of making a double ply sock includes knitting a singular tubular garment having a first section formed of undyed yarn and a second section of dyed yarn. The undyed section is inserted into the dyed section forming a two-ply construction having an undyed inner ply.

31 Claims, 1 Drawing Sheet

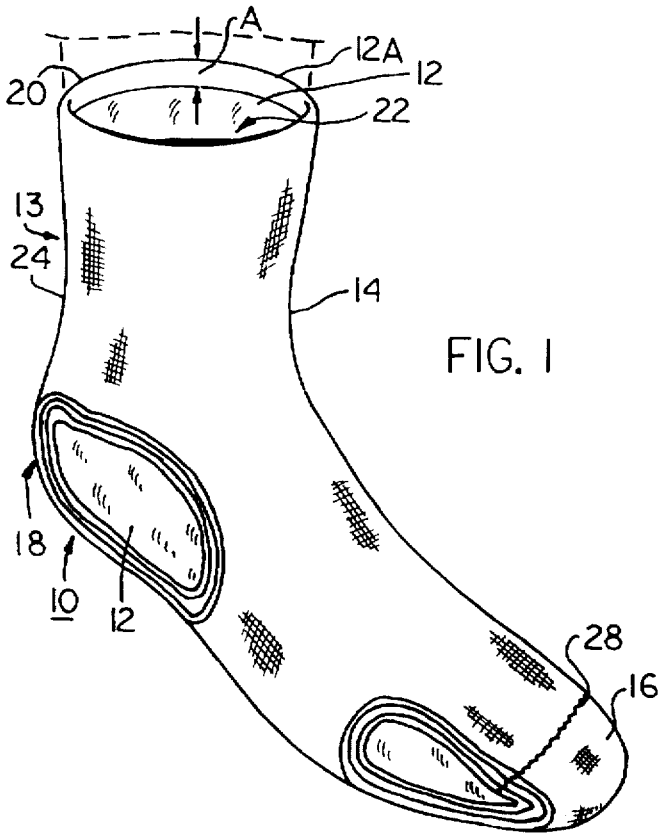
FIG. 1
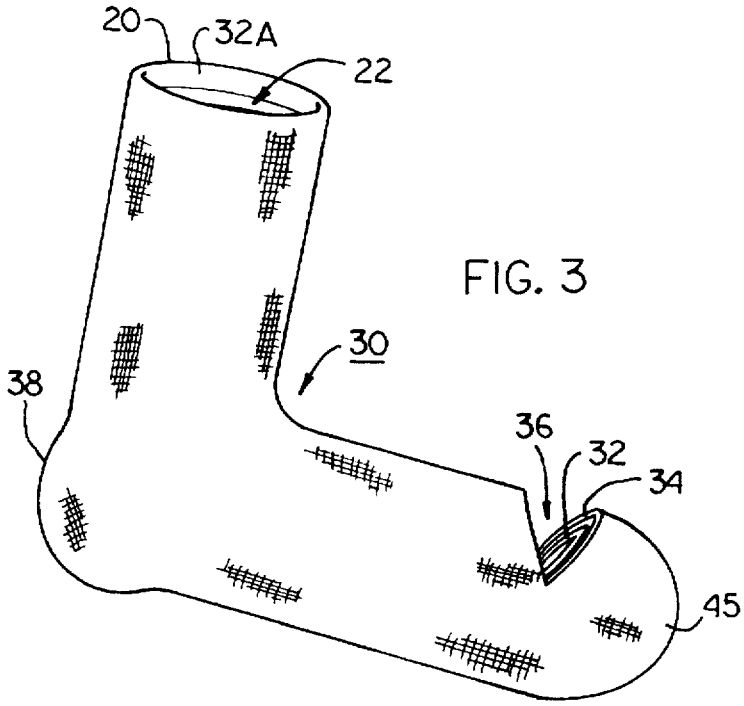
FIG. 3
FIG. 2
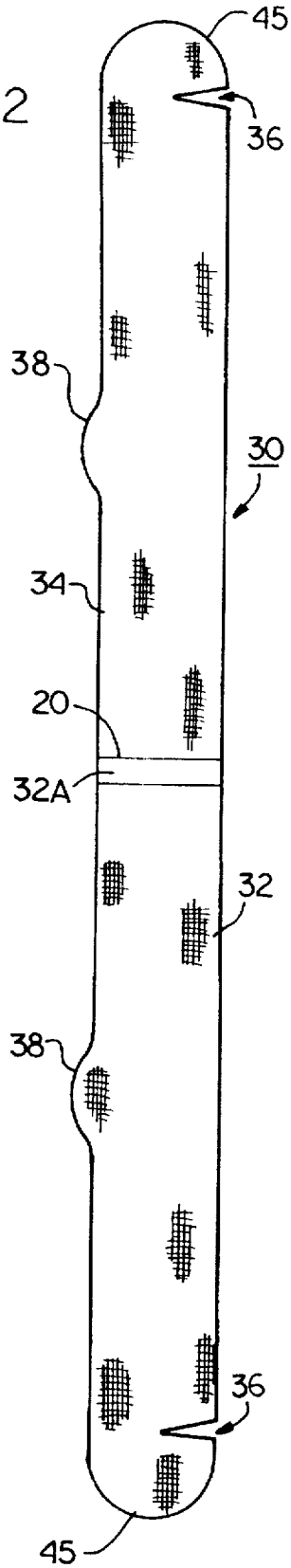

DOUBLE PLY SOCK AND METHOD OF MAKING SAME

FIELD OF THE INVENTION

The present invention relates to socks in general, more specifically, to a double ply sock having an undyed inner ply.

BACKGROUND OF THE INVENTION

Double ply socks have a number of useful advantages over single ply socks including: increased padding for jogging and running; blister protection resulting from reduced movement between the user's foot and the inner ply of the sock; increased warmth attributable to the insulation of the additional layer; and various other advantages. With these advantages, there are also several limitations.

Previously available double ply socks generally have dyed inner ply's formed of dyed yarns. The inner ply contacts the user's skin, and the dyed material may cause irritation of the skin because the sock is typically tightly fitted to the foot for extended periods of time. The possibility of irritation is often increased by a tightly fitted shoe or perspiration from the foot which interacts with the dyed material.

This is a particular concern for many people, such as diabetics, who are unable to wear dyed socks because of medical reasons. Currently available socks are either completely dyed or completely undyed, either of which is unacceptable. Persons with medical requirements are not able to wear a dyed sock material that contacts their foot, but on the other hand undyed socks are often not fashionably correct, for example when worn with business attire.

A sock having an undyed inner lining is disclosed in U.S. Pat. No. 379,831 issued to Sutro. The lower foot piece of the sock is constructed separately and then attached to the remainder of the sock. There is no discussion in Sutro of suitable or preferred materials for forming the inner ply. The disclosed sock and method of manufacture suffer from several significant drawbacks. For example, if formed from cotton or other hydrophilic material, the sock would tend to absorb and hold perspiration against the skin. The seam along the attachment between the lower foot piece and the sock may cause discomfort. In any event, the disclosed sock does not provide a primary benefit of the "double ply" socks, namely the reduction of friction between the entire foot and the shoe.

Double ply socks currently available have increased costs as the amount of material required can be double that of single ply socks. The provision of a finished and dyed inner ply is generally not cost effective as this ply is hidden from view by the outer ply and is not seen when the sock is worn. A person wanting the advantages of a double ply is forced to endure the additional cost without receiving a proportionate benefit.

SUMMARY OF THE INVENTION

The present invention is generally directed to a double ply sock which overcomes the various deficiencies noted above, and a method for forming the same. In each embodiment, the double ply sock is provided with an inner ply which is substantially undyed and which is undyed throughout the entire foot portion thereof. Preferably, the sock is particularly constructed and provided with certain features and materials discussed below.

The present invention is directed to a double ply sock. The sock comprises an inner ply including a foot portion and formed from hydrophobic yarns. At least the foot portion of the inner ply is undyed. An outer ply of dyed yarn surrounds the inner ply. The outer ply is joined to the inner ply at an upper end of the inner and outer plies.

Preferably, the above described sock has inner and outer plies joined proximate a top opening which is arranged and configured to receive a wearer's foot. The plies may be joined by a common seam proximate a toe end of the sock. The sock may be formed such that the inner and outer plies are of a single, continuous tube of knitted material. In such case, the inner and outer plies are joined by a fold line proximate the top opening of the sock and configured to receive the wearer's foot. The inner ply may include a dyed band immediately adjacent the fold line and an undyed upper portion extending between the dyed band and the foot portion. Alternatively, the inner ply may be undyed in its entirety. Moreover, the inner ply may be formed from an antimicrobial material.

The present invention is further directed to a double ply sock according to a second embodiment as follows. The sock includes an inner ply including a foot portion and formed from antimicrobial yarns. At least the foot portion is undyed. An outer ply of dyed yarn surrounds the inner ply. The outer ply is joined to the inner ply at an upper end of the inner and outer plies. The sock may be modified and constructed in the same manner as described above with respect to the sock according to the first embodiment.

The present invention is further directed to a sock comprising a unitary, continuous tube of knitted material having a first and second end. The tube is folded about a fold line such that a first portion of the tube extends between the fold line and the first end and forms an outer ply. The outer ply is at least partially dyed. A second portion of the tube extends between the fold line and the second end to form an inner ply that is disposed within the outer ply. The first end is closed to form an outer toe portion and the second end is closed to form an inner toe portion. The inner ply includes a foot portion. At least the foot portion of the inner ply is undyed.

In the sock described immediately above, the inner and outer plies are preferably substantially coextensive. A common seam may close each of the first and second ends. The sock may be knit from hydrophobic or antimicrobial yarns, or may be knit from both antimicrobial and hydrophobic yarns. Preferably, the outer ply of the sock is dyed.

The present invention is further directed to a method of making a two ply sock. The first step is to knit a singular tubular garment having a first continuous section formed of undyed yam and a second continuous section formed of dyed yam. Next, the first section is inserted into the second section to form a two-ply construction having an inner ply including at least the first section and an outer ply including the second section. The construction has a folded end and an open end opposite the folded end. The method includes the further step of closing the open end.

In the above method, the tube is preferably knit such that each of the first and second sections extend the entire length of the sock. The first section may be knit from an antimicrobial or hydrophobic yarn, or a combination of both antimicrobial and hydrophobic yarn. The tubular garment may be knit to include a third, dyed section between the first and second sections. The third section is inserted into the second section along with the first section so that the inner ply includes the third section adjacent the folded end.

A primary object of the present invention is to provide an improved double ply sock.

It is an object of the present invention to provide a double ply sock having an undyed inner ply.

An object of the present invention is to provide a double ply sock at a reduced manufacturing cost by using less expensive undyed materials on the inner ply.

Another object of the present invention is to provide a sock which minimizes skin irritations caused by contact with the dyed material.

Another object of the present invention is to make available for persons with medical requirements, such as persons with diabetes, a sock having an undyed inner ply that contacts the wearers foot and a dyed outer ply for a fashionable appearance.

It is an object of the present invention to provide a sock which provides the appearance of dyed material without subjecting the wearer's foot to contact with dyed material.

It is another object to provide a double ply sock with an inner ply which is both undyed and also formed of hydrophobic yarn.

Another object is to provide a double ply sock with an undyed inner ply of antimicrobial yarn.

Yet another object is to provide a double ply sock with an inner ply which is undyed and formed of hydrophobic and antimicrobial yarn.

The preceding and further objects of the present invention will be appreciated by those of ordinary skill in the art from a reading of the figures and the detailed description of the preferred embodiment which follow, such description being merely illustrative of the present invention.

BRIEF DESCRIPTION OF THE DRAWINGS

FIG. 1 is a fragmentary side elevation view of a sock according to the present invention.

FIG. 2 is a side elevational view of a unitary, continuous knitted tube for forming a sock according to the present invention.

FIG. 3 is a side elevational view of the knitted tube with a first portion thereof to form a two ply construction.

DETAILED DESCRIPTION OF THE INVENTION

With reference to FIG. 1, a sock according to the present invention is shown therein and generally denoted by the numeral 10. Sock 10 has foot portion 11 and leg portion 13, and includes inner ply 12 and outer ply 14 surrounding inner ply 12. Each of inner ply 12 and outer ply 14 extend the entire length from toe portion 16, through heel pocket 18 and calf portion 24, and to fold line 20. Inner ply 12 and outer ply 14 are joined at fold line 20. Preferably, the inner ply 12 and outer ply 14 are integrally formed as discussed below. Fold line 20 is arranged and configured to form a top opening 22 to receive a wearer's foot. Inner ply 12 and outer ply 14 are sewn together and closed by common seam 28. While sock 10 may be of any length, it is preferably sized such that top opening 22 is positioned at or just above the wearer's calf when the sock is worn.

Foot portion 11 of inner ply 12 extends from the top of heel pocket 18 to the toe end of the sock. This is essentially the portion of inner ply 12 which will be disposed in a wearer's typical non-high top shoe. Notably, all of the inner ply 12 in foot portion 11 is formed from undyed yarn. By contrast, outer ply 14 is formed of dyed yarns substantially throughout its length. Preferably, all of inner ply 12 in leg portion 13 (i.e., extending from the top of the heel pocket to the top opening) is formed of undyed yarn except band 12A adjacent top opening 22 as shown. Dyed band 12A adjoins dyed outer ply 14, creating the impression that inner ply 12 is dyed throughout its length as well. Preferably, the width A of band 12A is no more than 5% of the total length of sock 10, and is preferably from about 0 to 5% the total length of sock 10. In any event, the lower edge of band 12A should be at least 2 inches from the top of heel pocket 18. It will be understood by one of ordinary skill in the art that the inner ply may be bleached. Additionally, the outer ply may be bleached.

The undyed yam reduces skin irritation and staining of the skin that results from contacting a dyed yam, particularly where the sock is tightly worn and perspiration from the foot can interact with the dye. Undyed inner ply 12 also provides for reduced production costs as the undyed yarn is less expensive. As the inner ply 12 is not visible when the sock is worn, there is no need for the aesthetic attributes of a dyed inner ply which would only increase production costs.

The comfort and wearability of sock 10 may be further enhanced by constructing inner ply 12 of hydrophobic yarn. Preferably, inner ply 12 is formed from only hydrophobic yarn. Any perspiration or dampness that the inner ply 12 receives tends to be wicked away from the skin by the hydrophobic properties. Suitable yarns include polypropylene, polyester, and other chemically treated yarns. Most preferred are COOLMAX® (Du Pont's polyester), polypropylene, and acrylic. Preferably, the yarn denier is in the range of from about 150 to 800. Sources of the above listed yarns will be readily apparent to those of ordinary skill in the art.

The inner and outer plies may be constructed of different deniers of yarn and the plies may be of different or equal thicknesses. The outer ply is typically thicker than the inner ply. For example, the inner ply may be constructed of polyester with the outer ply constructed of wool.

The sock of the present invention may be further enhanced by the incorporation of antimicrobial materials in undyed inner ply 12, particularly in foot portion 11. Antimicrobial materials may include materials having antibacterial and/or antifungal properties. Suitable antimicrobial materials include MICROSAFE AM™. The yarn may be pre-treated with an antimicrobial substance or the fabric may be coated with an antimicrobial substance after the inner ply 12 has been knit. The antimicrobial material serves to kill fungus associated with the wearer's foot or which tend to grow in the sock material. Preferably, the antimicrobial material is used in conjunction with hydrophobic yarns as discussed above, though this is not required.

With reference to FIGS. 2 and 3, sock 10 may be formed in the following manner. A unitary tube 30 is knit using a conventional circular knitting machine. Suitable machines include any 54 to 240 needle, 1½6 inches diameter circular hosiery knitting machine available from Speizman Industries, P.A.M. Trading Co., and others. First, section 34 is knit using dyed yarn and so as to form a toe pocket 45 and a heel pocket 38. Dyed section 34 corresponds to outer ply 14. Preferably, the tube is further knit using the dyed yarn to form section 32A corresponding to dyed band 12A of inner ply 12. Thereafter, the dyed yarn is removed and undyed yarn is inserted to form section 32 which corresponds to inner ply 12, again with a toe pocket 45 and a heel pocket 38 being formed. If the sock being formed is to incorporate a hydrophobic and/or antimicrobial treated yarn, such yarn is used to form section 32. Preferably, section 34 is of a ribbed design while section 32 is flat knit. Tube 30 so formed has open ends 36. It will be appreciated that the order of formation of sections 32, 32A, and 34 may be reversed.

As shown in FIG. 3, after tube 30 has been knit, undyed section 32 is inserted into dyed section 34, tube 30 being folded about fold line 20 which lies between dyed section 34 and section 32A. Each of openings 36 are sewn closed by common seam 28 thereby forming toe portion 16. An alternative embodiment includes closing the respective toe ends by separate seams. It will be apparent to one of ordinary skill in the art that dyed section 34 may be inserted within undyed section 32 to provide for openings 36 to be sewn shut on the interior of the sock. After toe portion 16 is sewn, sock 10 is reversed to the normal alignment with outer ply 14 on the exterior.

An alternative embodiment of the present invention is contemplated wherein dyed section 32 is formed separately from undyed section 34. The sections are attached by sewing or similar methods adjacent the top opening 22.

While preferred embodiments of the present invention have been described, it will be appreciated by those of ordinary skill in the art that certain modifications may be made without departing from the scope of the present invention. All such modifications are intended to come within the scope of the claims which follow.

What is claimed is:

1. A hygienic, moisture management sock comprising a unitary, continuous tube of knitted material having a first end and a second end, said tube folded about a fold line such that a first portion of said tube extending between said fold line and said first end forms an outer ply and a second portion of said tube extending between said fold line and said second end forms an inner ply disposed within and substantially coextensive with said outer ply, said first end closed to form an outer toe portion, said second end closed to form an inner toe portion, said inner and outer plies each including a tubular foot portion, and wherein at least the entirety of said foot portion of said inner ply is undyed and said outer ply is at least partially dyed.

2. The sock of claim 1, wherein a common seam closes each of said first and second ends.

3. The sock of claim 1, wherein said outer ply is completely dyed.

4. The sock of claim 1 wherein said inner ply includes a dyed band immediately adjacent said fold line and an undyed upper portion extending between said dyed band and said foot portion of said inner ply.

5. A method of making a hygienic, moisture management two ply sock, comprising the steps of:

a) knitting a singular tubular garment having a first continuous section and a second continuous section, the first section being formed of undyed yarn and the second section being formed of dyed yarn;

b) inserting the first section into the second section so as to form a two-ply construction having an inner ply including at least the first section and an outer ply including the second section, the construction having a folded end and an open end opposite the folded end, the inner and outer plies being substantially coextensive and each having a tubular foot portion, the foot portion of the inner ply formed from the first c) closing the open end.

6. The method of claim 5, wherein said step of knitting includes knitting the first section from an antimicrobial yarn.

7. The method of claim 5, wherein said step of knitting includes knitting the first section from a hydrophobic yarn.

8. The method of claim 5, wherein said step of knitting includes knitting the first section from hydrophobic and antimicrobial yarn.

9. The method of claim 5, wherein said step of knitting includes knitting the tubular garment so as to further include a third, dyed section between the first and second sections, and wherein said step of inserting includes inserting the third section into the second section along with the first section so that the inner ply includes the third section adjacent the folded end.

10. A hygienic, moisture management sock comprising a unitary, continuous tube of knitted material having a first end and a second end, said tube folded about a fold line such that a first portion of said tube extending between said fold line and said first end forms an outer ply and a second portion of said tube extending between said fold line and said second end forms an inner ply disposed within and substantially coextensive with said outer ply, said first end closed to form an outer toe portion, said second end closed to form an inner toe portion, said inner and outer plies each including a tubular foot portion, wherein at least the entirety of said foot portion of said inner ply is undyed and said outer ply is at least partially dyed; and wherein at least said foot portion of said inner ply is knit from hydrophobic yarns.

11. The sock of claim 10, wherein a common seam closes each of said first and second ends.

12. The sock of claim 10, wherein said inner ply is knit from antimicrobial yarns.

13. The sock of claim 10, wherein said outer ply is completely dyed.

14. The sock of claim 10, wherein said inner ply includes a dyed band immediately adjacent said fold line and an undyed upper portion extending between said dyed band and said foot portion of said inner ply.

15. The sock of claim 10, wherein said inner ply is undyed in its entirety.

16. A hygienic, moisture management sock comprising a unitary, continuous tube of knitted material having a first end and a second end, said tube folded about a fold line such that a first portion of said tube extending between said fold line and said first end forms an outer ply and a second portion of said tube extending between said fold line and said second end forms an inner ply disposed within and substantially coextensive with said outer ply, said first end closed to form an outer toe portion, said second end closed to form an inner toe portion, said inner and outer plies each including a tubular foot portion, wherein at least the entirety of said foot portion of said inner ply is undyed and said outer ply is at least partially dyed; and wherein at least said foot portion of said inner ply is knit from antimicrobial yarns.

17. The sock of claim 16, wherein a common seam closes each of said first and second ends.

18. The sock of claim 16, wherein said outer ply is completely dyed.

19. The sock of claim 16, wherein said inner ply includes a dyed band immediately adjacent said fold line and an undyed upper portion extending between said dyed band and said foot portion.

20. The sock of claim 16 wherein said inner ply is undyed in its entirety.

21. A hygienic, moisture management sock comprising a unitary, continuous tube of knitted material having a first end and a second end, said tube folded about a fold line such that a first portion of said tube extending between said fold line and said first end forms an outer ply and a second portion of said tube extending between said fold line and said second end forms an inner ply disposed within and substantially coextensive with said outer ply, said first end closed to form an outer toe portion, said second end closed to form an inner toe portion, said inner and outer plies each including a foot portion, wherein at least the entirety of said foot portion of said inner ply is undyed and said outer ply is at least partially dyed; and wherein said foot portions are formed of plain stitches.

22. The sock of claim 21, wherein a common seam closes each of said first and second ends.

23. The sock of claim 21, wherein said inner ply is knit from hydrophobic yarns.

24. The sock of claim 21, wherein said inner ply is knit from antimicrobial yarns.

25. The sock of claim 21, wherein said inner ply is knit from antimicrobial and hydrophobic yarns.

26. The sock of claim 21, wherein said outer ply is completely dyed.

27. The sock of claim 21, wherein said inner ply includes a dyed band immediately adjacent said fold line and an undyed upper portion extending between said dyed band and said foot portion.

28. The sock of claim 21, wherein said inner ply is undyed in its entirety.

29. A hygienic, moisture management sock comprising a unitary, continuous tube of knitted material having a first end and a second end, said tube folded about a fold line such that a first portion of said tube extending between said fold line and said first end forms an outer ply and a second portion of said tube extending between said fold line and said second end forms an inner ply disposed within and substantially coextensive with said outer ply, said first end closed to form an outer toe portion, said second end closed to form an inner toe portion, said inner and outer plies each including a foot portion, wherein at least the entirety of said foot portion of said inner ply is undyed and said outer ply is completely dyed, wherein at least said foot portion of said inner ply is knit from hydrophobic, antimicrobial yarns, and wherein said foot portions are formed of plain stitches.

30. The sock of claim 29, wherein a common seam closes each of said first and second ends.

31. The sock of claim 29, wherein said inner ply includes a dyed band immediately adjacent said fold line and an undyed upper portion extending between said dyed band and said foot portion.

* * * * *

UNITED STATES PATENT AND TRADEMARK OFFICE

CERTIFICATE OF CORRECTION

PATENT NO. : 5778702
DATED : July 14, 1998
INVENTOR(S) : Jerry O. Wrightenberry

It is certified that error appears in the above-identified patent and that said Letters Patent is hereby corrected as shown below:

In Claim 5(b), line 8, insert the words -- section only; and -- after the word "first."

Signed and Sealed this

Twentieth Day of October, 1998

Bruce Lehman

*Attest:*

BRUCE LEHMAN

*Attesting Officer*

*Commissioner of Patents and Trademarks*